US007971682B2

(12) United States Patent
Inoue et al.

(10) Patent No.: US 7,971,682 B2
(45) Date of Patent: Jul. 5, 2011

(54) EXHAUST DEVICE FOR ENGINE

(75) Inventors: Yusuke Inoue, Wako (JP); Shigesato Nakamura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/715,809

(22) Filed: Mar. 2, 2010

(65) Prior Publication Data

US 2010/0230204 A1 Sep. 16, 2010

(30) Foreign Application Priority Data

Mar. 16, 2009 (JP) ..... 2009-063111

(51) Int. Cl.
*F01N 1/08* (2006.01)

(52) U.S. Cl. ..... 181/269; 181/227; 181/212

(58) Field of Classification Search ..... 181/227, 181/269, 212
See application file for complete search history.

(56) References Cited

U.S. PATENT DOCUMENTS

| | | | | |
|---|---|---|---|---|
| 4,050,539 | A * | 9/1977 | Kashiwara et al. | 181/280 |
| 4,109,753 | A * | 8/1978 | Lyman | 181/252 |
| 4,966,253 | A * | 10/1990 | Stephens et al. | 181/227 |
| 5,058,381 | A * | 10/1991 | Christenson et al. | 60/299 |
| 5,962,822 | A * | 10/1999 | May | 181/264 |
| 7,331,422 | B2 * | 2/2008 | Wall | 181/279 |
| 7,350,620 | B2 * | 4/2008 | Lalonde | 181/270 |
| 2006/0283661 | A1 * | 12/2006 | Tanaka et al. | 181/269 |
| 2008/0053748 | A1 * | 3/2008 | Emler | 181/212 |

FOREIGN PATENT DOCUMENTS

JP 2001-227336 8/2001

* cited by examiner

*Primary Examiner* — Forrest M Phillips
(74) *Attorney, Agent, or Firm* — Squire, Sanders & Dempsey (US) LLP

(57) ABSTRACT

An exhaust device for an engine cam include a flow rectifying device for rectifying a flow of an exhaust gas. The flow rectifying device is disposed in an upstream end of an inner pipe, and comprises protrusions projecting inwardly. The exhaust gas engaging the flow rectifying device has passed through a curved portion of the inner pipe. The inner pipe also includes a muffler having a plurality of vent holes disposed in an inner portion thereof, and an outer pipe surrounding the inner pipe, defining an angular chamber therebetween.

12 Claims, 9 Drawing Sheets

EXHAUST DEVICE FOR ENGINE

BACKGROUND

1. Field

The present invention relates to an exhaust device for an engine which has a muffler connected to an exhaust pipe having a curved portion or a bent portion.

2. Description of the Related Art

Exhaust devices for engines in which the downstream portion of an exhaust pipe connected to a muffler is curved are already known from documents such Patent Document 1, Japanese Patent Laid-Open No. 2001-227336.

If the curved or bent downstream portion of the exhaust pipe develops a pressure distribution such that the pressure of the exhaust gas in the muffler changes circumferentially, then the pressure of the exhaust gas in the muffler tends to become unbalanced, failing to sufficiently deliver the engine output.

As disclosed in Patent Document 1, in a muffler having an annular chamber defined between inner and outer pipes and filled with an acoustic absorbent such as glass wool or the like, the unbalanced pressure of the exhaust gas in the inner pipe may possibly cause an unbalanced deterioration of the acoustic absorbent, tending to shorten the interval for replacing the acoustic absorbent.

SUMMARY

The present invention has been made in view of the above drawbacks. It is an object of the present invention to provide an exhaust device for an engine which is capable of sufficiently delivering the engine output by rectifying an exhaust gas flow regardless of the fact that the exhaust pipe has a curved portion or a bent portion.

In one embodiment, and exhaust device for an engine includes a flow rectifying means for rectifying a flow of an exhaust gas. The flow rectifying means is disposed in an upstream end of the inner pipe. The flow rectifying means comprises protrusions projecting inwardly. Exhaust gas engaging the flow rectifying means has passed through a curved portion of the exhaust pipe, and the exhaust pipe also includes a muffler having a plurality of vent holes disposed in an inner portion thereof, and an outer pipe surrounds the inner pipe, thereby defining an angular chamber therebetween.

In another embodiment, an exhaust device for an engine comprises an exhaust pipe having an inner surface thereof and a curved portion configured to be attached to the engine at an upstream portion thereof. The exhaust pipe is also configured to be attached to a muffler at a downstream portion thereof. A protrusion projects inwardly from an inner surface of the exhaust pipe. The protrusion is disposed downstream of the curved portion. The protrusion is configured to rectify flow of an exhaust gas which has passed through the curved portion.

In yet another embodiment, an exhaust device for an engine comprises an exhaust pipe having a curved portion at one end thereof, with the curved portion being configured to be attached to an engine, with the exhaust pipe also configured to be attached to a muffler at a downstream end thereof. The muffler comprises an inner pipe having a number of vent holes thereupon and an outer pipe surrounding the inner pipe, thereby defining an angular chamber between the outer pipe and the inner pipe. At least one flow rectifying protrusion is disposed on an inner surface of an upstream end of the inner pipe. The protrusion is configured to rectify flow of exhaust gas which has passed through the curved portion.

In another embodiment, an exhaust device for an engine comprises an exhaust pipe having a curved portion at an upstream end thereof, and at least one flow rectifying protrusion projecting inwardly from an inner surface of the exhaust pipe. The flow rectifying protrusion is disposed downstream of the curved portion. The protrusion is configured to rectify a flow of an exhaust gas which has passed through the curved portion.

To achieve the above object, the present invention can have a first feature providing an exhaust device for an engine which has a muffler connected to an exhaust pipe having a curved portion or a bent portion, wherein the muffler includes an inner pipe having a number of vent holes and having an upstream end coupled to the exhaust pipe, and an outer pipe surrounding the inner pipe with an annular chamber defined between the inner pipe and the outer pipe, wherein flow rectifying means having protrusions projecting inwardly from an inner surface of the upstream end of the inner pipe is disposed in the upstream end of the inner pipe such that the protrusions rectify the flow of an exhaust gas which has passed through the bent portion or the curved portion of the exhaust pipe.

In addition to the arrangement of the first feature, the present invention can have a second feature in that the flow rectifying means includes a first flow rectifying member fixed to the inner surface of the inner pipe and a second flow rectifying member fixed to the inner surface of the inner pipe downstream of the first flow rectifying member, the first and second flow rectifying members having the protrusions projecting integrally therewith inwardly from the upstream end of the inner pipe.

In addition to the arrangement of the second feature, the present invention can have a third feature in that the protrusion is tilted so as to be progressively spaced from the inner surface of the inner pipe downstream with respect to the direction in which the exhaust gas flows through the inner pipe, and the distance between the projecting end of the protrusion and the inner surface of the inner pipe in a region where a pressure distribution of the exhaust gas in the inner pipe exhibits a highest pressure is greater than the distances at other portions of the projecting end.

In addition to the arrangement of the second or third feature, the present invention has a fourth feature in that the first and second flow rectifying members have an arcuate cross-sectional shape in a plane perpendicular to the axis of the inner pipe.

The present invention has a fifth feature providing an exhaust device for an engine which has a muffler connected to an exhaust pipe having a curved portion or a bent portion, wherein flow rectifying means having a protrusion projecting inwardly from an inner surface of the exhaust pipe downstream of the curved portion or the bent portion is disposed in the exhaust pipe such that the protrusion rectifies the flow of an exhaust gas which has passed through the curved portion or the bent portion.

In addition to the arrangement of any one of the first through fifth features, embodiments of the present invention can have a sixth feature in that the flow rectifying means is disposed downstream of the curved portion or the curved portion outwardly of the curved direction or the bent direction.

According to the first feature of the present invention, even though the exhaust pipe has the curved portion or the bent portion in its downstream portion for developing a pressure distribution such that the pressure of the exhaust gas in the muffler at the upstream end of the inner pipe changes circumferentially, since the flow rectifying means having protrusions projecting inwardly from the inner surface of the inner pipe in a region where a pressure distribution of the exhaust gas in the inner pipe exhibits a highest pressure is disposed in the upstream end of the inner pipe such that the protrusions rectify the flow of an exhaust gas, the pressure of the exhaust gas in the inner pipe is uniformized and the flow of the exhaust gas is made smooth, thus increasing the engine output. Even if the annular chamber between the inner pipe and the outer pipe is filled an acoustic absorbent, the acoustic absorbent will not suffer an unbalanced deterioration, and will be replaced at an extended interval.

According to the second feature of the present invention, since the flow rectifying means includes a first flow rectifying member and a second flow rectifying member disposed downstream of the first flow rectifying member, the flow of the exhaust gas is mainly rectified by the second flow rectifying member when the engine is in a low rotational speed range and the exhaust gas flows at a low speed, and the flow of the exhaust gas is mainly rectified by the first flow rectifying member when the engine is in a high rotational speed range and the exhaust gas flows at a high speed. Thus, the flow rectifying means provides a flow rectifying capability in a wide range of engine loads for increasing the engine output.

According to the third feature of the present invention, since the protrusion of the flow rectifying means is tilted so as to be progressively spaced from the inner surface of the inner pipe downstream with respect to the direction in which the exhaust gas flows through the inner pipe, and the distance between the projecting end of the protrusion and the inner surface of the inner pipe in a region where the pressure is highest is greater than the distances at other portions of the projecting end, the pressure of the exhaust gas is effectively uniformized and the flow of the exhaust gas is made smooth.

According to the fourth feature of the present invention, since the first and second flow rectifying members have an arcuate cross-sectional shape in a plane perpendicular to the axis of the inner pipe, any increase in the resistance to the flow in the inner pipe is minimized.

According to the fifth feature of the present invention, even though the exhaust pipe has the curved portion or the bent portion for developing a pressure distribution such that the pressure of the exhaust gas in the exhaust pipe changes circumferentially, since flow rectifying means having a protrusion projecting inwardly from an inner surface of the exhaust pipe downstream of the curved portion or the bent portion in a region where a pressure distribution of the exhaust gas exhibits a highest pressure is disposed in the exhaust pipe such that the protrusion rectifies the flow of an exhaust gas, the pressure of the exhaust gas in the exhaust pipe is uniformized and the flow of the exhaust gas is made smooth for increasing the engine output.

According to the sixth feature of the present invention, since the flow rectifying means is disposed outwardly of the curved direction or the bent direction, the flow rectifying means can effectively be disposed in the region where the pressure distribution of the exhaust gas exhibits the highest pressure.

DESCRIPTION OF PREFERRED EMBODIMENTS

Embodiments of the present invention will be described below with reference to the accompanying drawings.

Figure 1:
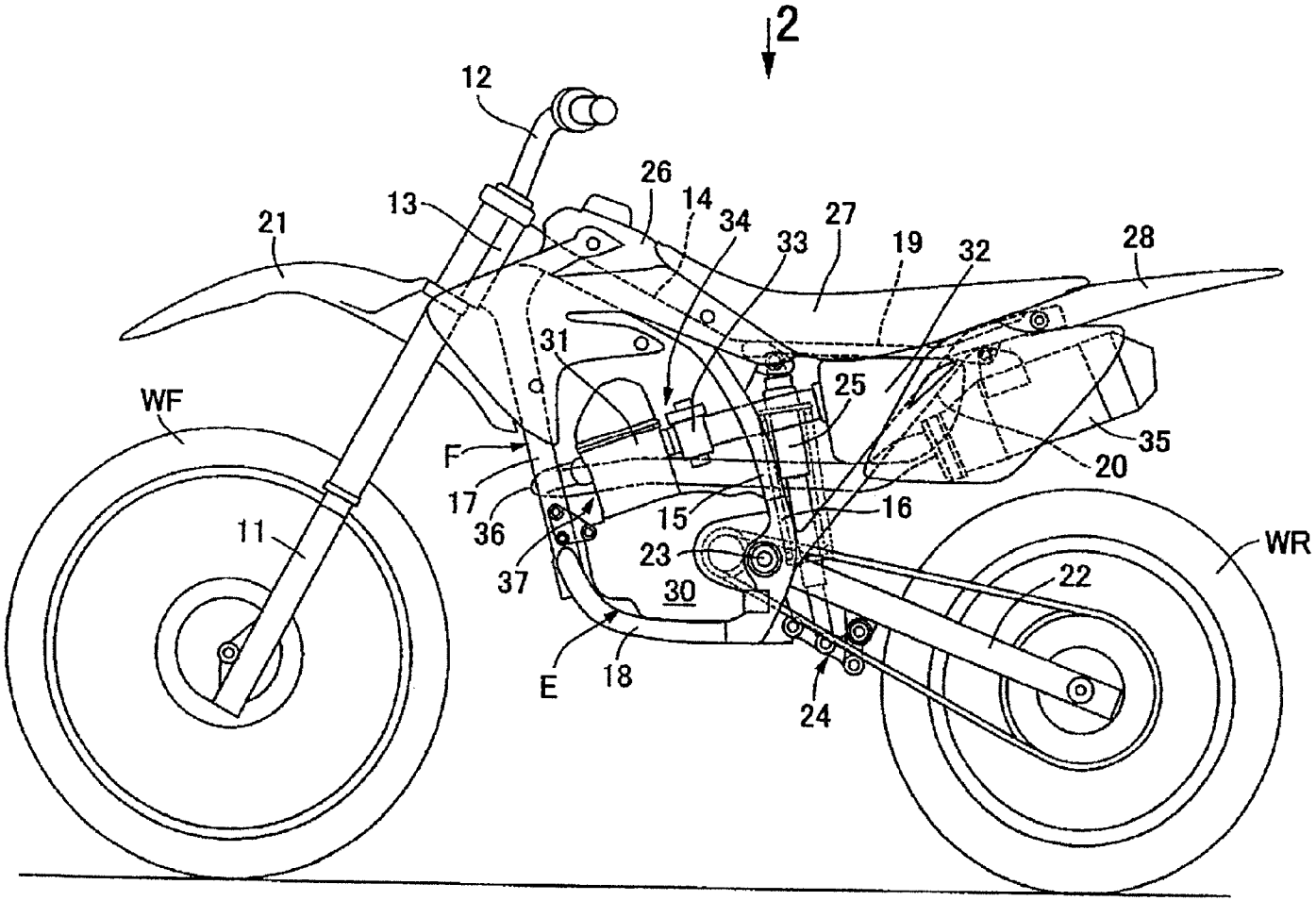
FIG. 1 is a left-hand side elevational view of a two-wheeled motorcycle according to embodiment 1.

Embodiment 1 of the present invention will be described, with reference to FIGS. 1 through 7. As shown in the example of FIG. 1, a two-wheeled motorcycle has a body frame F including a head pipe 13 on which there are steerably supported a front fork 11 that supports a front wheel WF and a steering handle 12 coupled to an upper portion of the front fork 11. A main frame 14 extends rearwardly and downwardly from the head pipe 13, and a pair of right and left central frames 15 extending downwardly from a rear portion of the main frame 14. A pair of right and left pivot plates 16 are mounted respectively on the lower ends of the central frames 15, and a down frame 17 is disposed below a front portion of the main frame 14 and extend downwardly from the head pipe 13. A pair of right and left lower frames 18 interconnects a lower portion of the down frame 17 and the pivot plates 16, and a pair of right and left seat rails 19 extend rearwardly and upwardly from a rear portion of the main frame 14. A pair of right and left rear frames 20 interconnect intermediate portions of the seat rails 19 and the pivot plates 16.

A front fender 21 which covers the front wheel WF from above can be mounted on the front fork 11. A rear wheel WR is supported by a shaft on a rear end portion of a swing arm 22 having a front end vertically swingably mounted on the pair of right and left pivot plates 16 by a support shaft 23. A link mechanism 24 is interposed between the pivot plates 16 and the rear fork 22, and a rear cushion 25 is interposed between the link mechanism 24 and front portions of the seat rails 19.

Figure 2:
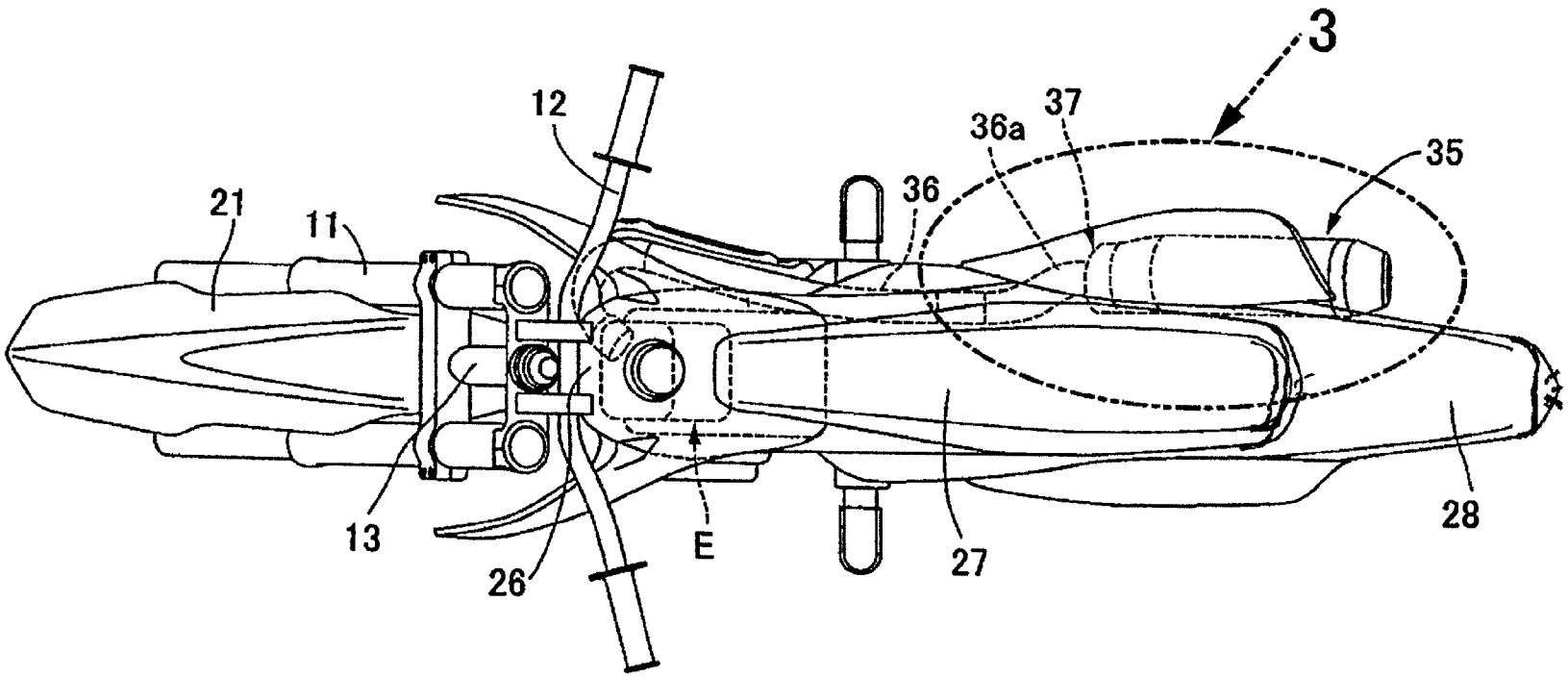
FIG. 2 is a plan view as seen in the direction indicated by the arrow 2 in FIG. 1.

As also shown in FIG. 2, a fuel tank 26 is mounted on a front portion of a pair of right and left main frame 14. A rider seat 27 can be disposed rearwardly of the fuel tank 26 and supported by the seat rails 19. A rear fender 28 is joined to the rear end of the rider seat 27.

An engine E has an engine body 30 disposed in a region surrounded by the main frame 14, the central frames 15, the pivot plates 16, the down frames 17, and the lower frames 18, and supported by the body frame F. In this example, the engine body 30 has a cylinder head 31 having a rear side wall to which there is connected a carburetor 33 of an intake device 34 which has an air cleaner 32 at an upstream end thereof. The cylinder head 31 has a front side wall to which there is connected an exhaust pipe 36 of an exhaust device 37 having on its downstream end a muffler 35 that is disposed on the right-hand side of the rear wheel WR. The exhaust pipe 36 is disposed such that it extends slightly forwardly from the front side wall of the cylinder head 31, is then curved to the right of the cylinder head 31, and extends on the right-hand side of the cylinder head 31 rearwardly to the muffler 35. The exhaust pipe 36 includes a curved portion **36*a*** in its downstream portion which is curved so as to protrude outwardly and be positioned upwardly in the rearward direction.

Figure 3:
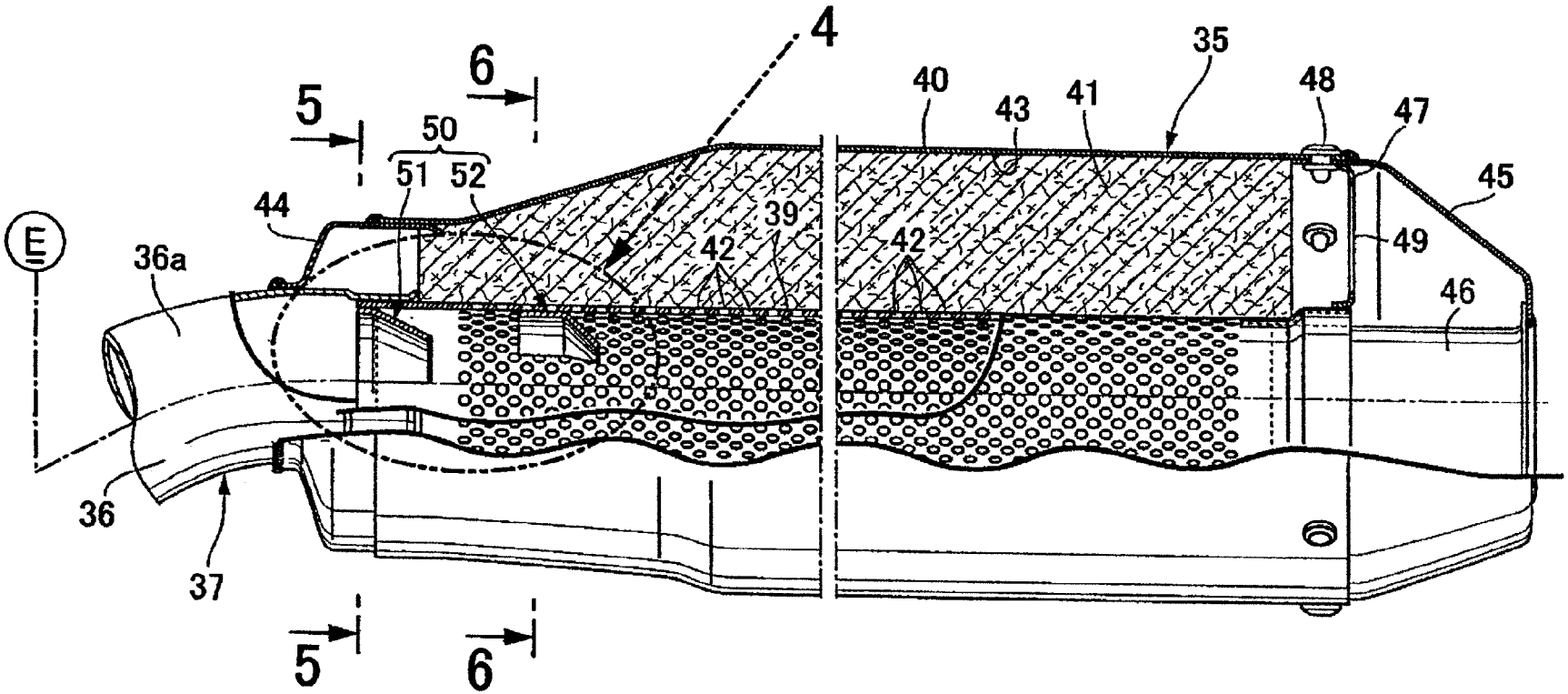
FIG. 3 is an enlarged horizontally sectional plan view as seen in the direction indicated by the arrow 3 in FIG. 2.

As shown in FIG. 3, the muffler 35 includes an inner pipe 39 having an upstream end connected to the exhaust pipe 36 and having a number of vent holes 42 defined therein, an outer pipe 40 surrounding the inner pipe 39 with an annular chamber 43 defined between the inner pipe 39 and the outer pipe 40, and an acoustic absorbent 41 such as glass wool or the like which fills up the annular chamber 43.

A cup-shaped front cover 44 is fixed to the front end of the outer pipe 40 to close the front portion of the outer pipe 40. The exhaust pipe 36 has a downstream portion extending centrally through the front cover 44. The front end of the front cover 44 is welded to the outer circumferential surface of the exhaust pipe 36 fully therearound. The outer pipe 40 has a rear end to which there is fixed a cup-shaped rear cover 45 that closes a rear portion of the outer pipe 40. An end pipe 46 which is open rearwardly has a downstream end fixed centrally to the rear cover 45.

The inner pipe 39 has an upstream end press-fitted in the downstream end of the exhaust pipe 36 and a downstream end in which the upstream end of the end pipe 46 is press-fitted. A separator 47 which supports the inner circumferential surface of the downstream end of the inner pipe 39 has an outer circumferential surface fastened to the rear end of the outer pipe 40 and the rear cover 45 by a plurality of rivets 48. The separator 47 has, in this embodiment, a plurality of through holes 49 defined therein.

The curved portion 36*a* is provided in the downstream portion of the exhaust pipe 36 and is curved so as to protrude outwardly and be positioned upwardly in the rearward direction. The curved portion 36*a* develops a pressure distribution in the upstream end of the inner pipe 39 such that the pressure of an exhaust gas changes circumferentially to produce a highest pressure outwardly of the curved direction of the curved portion 36*a*. In Embodiment 1, a pressure distribution such that the pressure is highest on the right-hand side of the inner pipe 39 with respect to the lateral direction of the two-wheeled motorcycle is developed in the upstream end of the inner pipe 39. According to certain embodiments of the present invention, a flow rectifying device or means 50 has protrusions 51*b*, 52*b* which project inwardly from an inner surface of the inner pipe 39 in a region where a pressure distribution of the exhaust gas in the upstream end of the inner pipe 39 downstream of the curved portion 36*a* exhibits a high pressure, i.e., outwardly of the curved direction of the curved portion 36*a* (on the right-hand side in Embodiment 1). The flow rectifying means 50 is disposed in the upstream end of the inner pipe 39, and the protrusions 51*b*, 52*b* rectify the flow of the exhaust gas.

Figure 4:
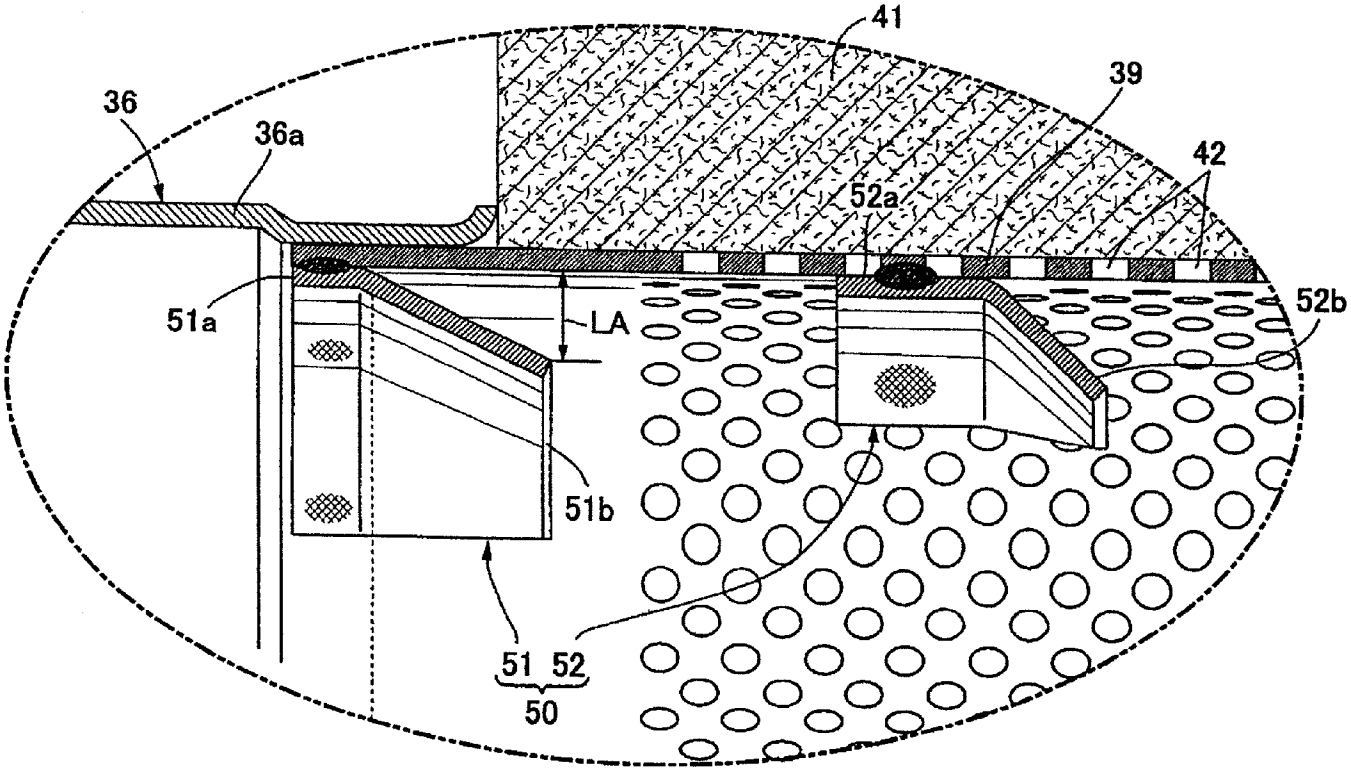
FIG. 4 is an enlarged view of a portion indicated by the arrow 4 in FIG. 3.
Figure 5:
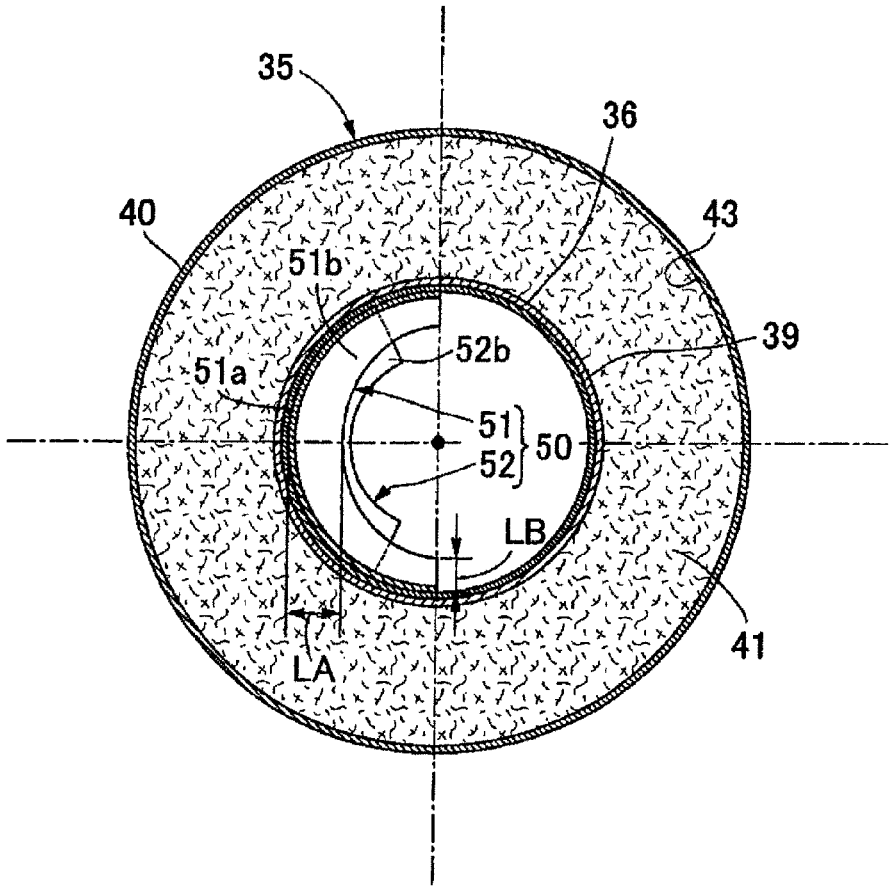
FIG. 5 is a cross-sectional view taken along line 5 to 5 of FIG. 3.
Figure 6:
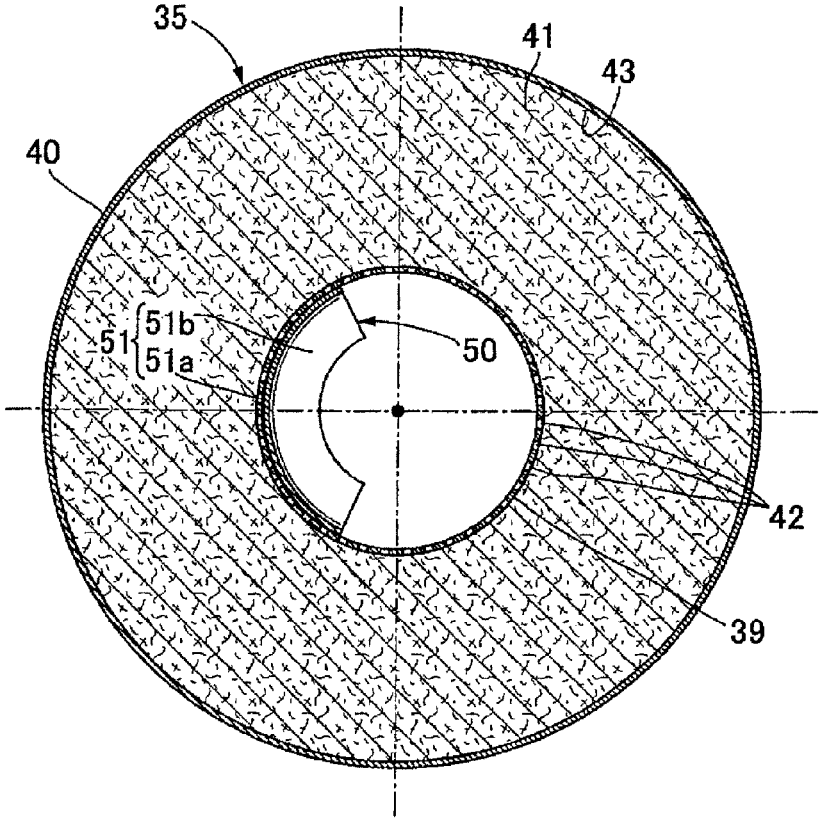
FIG. 6 is a cross-sectional view taken along line 6 to 6 of FIG. 3.

As also shown in FIGS. 4 through 6, the flow rectifying means 50 includes a first flow rectifying member 51 fixed to the inner surface of the upstream end of the inner pipe 39 and a second flow rectifying member fixed to the inner surface of the inner pipe 39 downstream of the first flow rectifying member 51.

In this embodiment, the first flow rectifying member 51 includes a base 51*a* fixed to the inner surface of the inner pipe 39 and the protrusion 51*b* projecting inwardly from the inner surface of the inner pipe 39 and integrally joined to the rear end of the base 51*a*. The second flow rectifying member 52 includes a base 52*a* fixed to the inner surface of the inner pipe 39 and the protrusion 52*b* projecting inwardly from the inner surface of the inner pipe 39 and integrally joined to the rear end of the base 52*a*. The first and second flow rectifying members 51, 52 have an arcuate cross-sectional shape in a plane perpendicular to the axis of the inner pipe 39. The protrusions 51*b*, 52*b* are tilted so as to be progressively spaced from the inner surface of the inner pipe 39 downstream with respect to the direction in which the exhaust gas flows through the inner pipe 39.

The distance between the projecting end of the protrusion 51*b* of the first flow rectifying member 51 and the inner surface of the upstream end of the inner pipe 39 in the region where the pressure distribution of the exhaust gas exhibits the highest pressure, i.e., the inner surface outward of the curved direction of the curved portion 36*a*, or the right-hand surface of the inner surface of the upstream end of the inner pipe 39 (the left-hand surface in FIG. 5) in Embodiment 1, is greater than the distances between the other portions of the projecting end and the inner surface of the inner pipe 39.

Specifically, the length of the projecting end of the protrusion 51*b* of the first flow rectifying member 51 from the base 51*a* is greatest at a circumferentially central portion of the protrusion 51*b* and is progressively smaller toward circumferentially opposite ends thereof. The first flow rectifying member 51 is fixed to the inner surface of the inner pipe 39 such that the circumferentially central portion of the protrusion 51*b* is disposed in the region where the pressure distribution of the exhaust gas exhibits the highest pressure. Consequently, the distance LA between the projecting end of the protrusion 51*b* in the region where the pressure distribution of the exhaust gas exhibits the highest pressure, i.e., the projecting end of the circumferentially central portion of the protrusion 51*b*, and the inner surface of the inner pipe 39 is greatest, and the distance LB between the projecting ends of the circumferentially opposite ends of the protrusion 51*b* and the inner surface of the inner pipe 39 is smallest.

Figure 7:
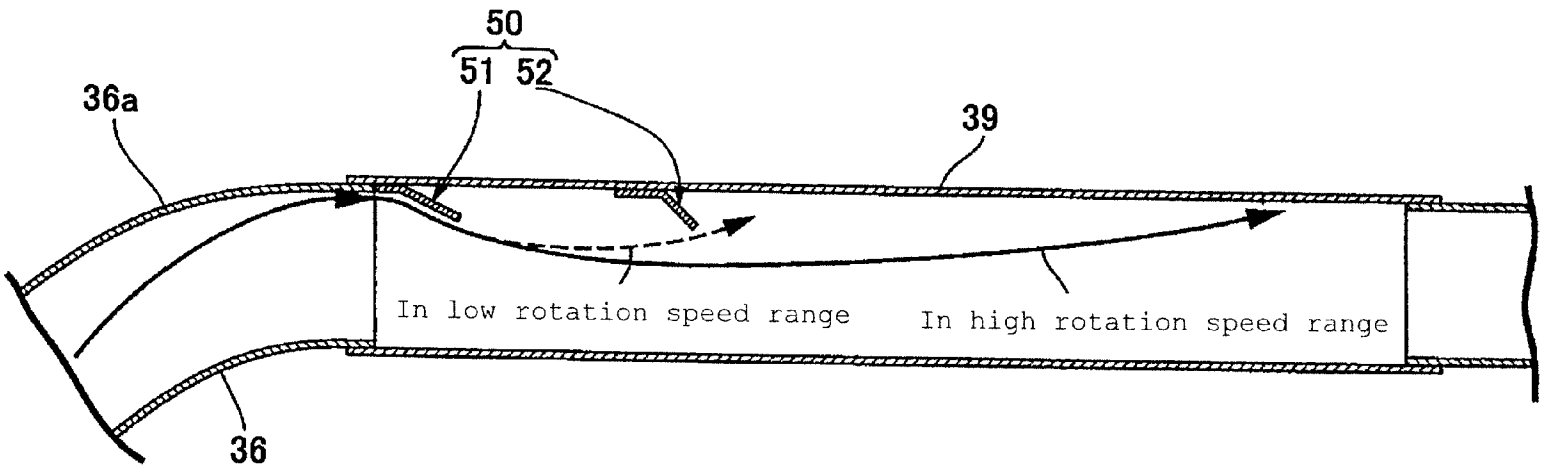
FIG. 7 is a view illustrative of exhaust gas flows in an exhaust pipe and an inner pipe.

As shown in FIG. 7, whereas the first flow rectifying member 51 is disposed so as to allow the exhaust gas to flow smoothly when the engine E is in a high rotational speed range, the second flow rectifying member 52 is disposed so as to exist in the flow of the exhaust gas that is deflected by the first flow rectifying member 51 when the engine E is in a low rotational speed range. When the engine E is in a high rotational speed range, the second flow rectifying member 52 minimizes its resistance to the exhaust gas, and when the engine E is in a low rotational speed range, the second flow rectifying member 52 presents a sufficient resistance to the exhaust gas.

Some advantages of Embodiment 1 will be described below. Even though the exhaust pipe 36 has the curved portion 36*a* in its downstream portion for developing a flow speed distribution such that the flow speed of the exhaust gas in the muffler 35 at the upstream end of the inner pipe 39 changes circumferentially, since the flow rectifying means 50 having protrusions 51*b*, 52*b* projecting inwardly from the inner surface of the inner pipe 39 in the region where the pressure distribution of the exhaust gas exhibits the highest pressure is disposed in the upstream end of the inner pipe 39 such that the protrusions 51*b*, 52*b* rectify the flow of the exhaust gas, the pressure of the exhaust gas in the inner pipe 39 is uniformized and the flow of the exhaust gas is made smooth, thus increasing the engine output. Even though the annular chamber 43 between the inner pipe 39 and the outer pipe 40 is filled the acoustic absorbent 41, the acoustic absorbent 41 will not suffer an unbalanced deterioration, and will be replaced at an extended interval.

Furthermore, since the flow rectifying means 50 is disposed in the upstream end of the inner pipe 39 with the protrusions 51*b*, 52*b* projecting inwardly from the inner surface of the inner pipe 39 outwardly of the curved direction of the curved portion 36*a* (on the right-hand side in Embodiment 1) of the exhaust pipe 36, the flow rectifying means 50 can effectively be disposed in the region where the pressure distribution of the exhaust gas exhibits the highest pressure.

Moreover, since the flow rectifying means 50 includes the first flow rectifying member 51 and the second flow rectifying member 52 disposed downstream of the first flow rectifying member 51, the flow of the exhaust gas is mainly rectified by the second flow rectifying member 52 when the engine E is in a low rotational speed range and the exhaust gas flows at a low speed, and the flow of the exhaust gas is mainly rectified by the first flow rectifying member 51 when the engine E is in a high rotational speed range and the exhaust gas flows at a high speed. Thus, the flow rectifying means can provide a flow rectifying capability in a wide range of engine loads for increasing the engine output.

Since the protrusion 51*b* of the first flow rectifying member 51 of the flow rectifying means 50 is tilted so as to be progressively spaced from the inner surface of the inner pipe 39 downstream with respect to the direction in which the exhaust gas flows through the inner pipe 39, and the distance LA between the projecting end of the protrusion 51*b* and the inner surface of the inner pipe 39 in the region where the pressure is highest is greater than the distances between the other portions of the projecting end and the inner surface of the inner pipe 39, the pressure of the exhaust gas is effectively uniformized and the flow of the exhaust gas is made smooth.

In addition, since the first and second flow rectifying members 51, 52 have the arcuate cross-sectional shape in the plane perpendicular to the axis of the inner pipe 39, any increase in the resistance to the flow in the inner pipe 39 is minimized.

Embodiment 2

Figure 8:
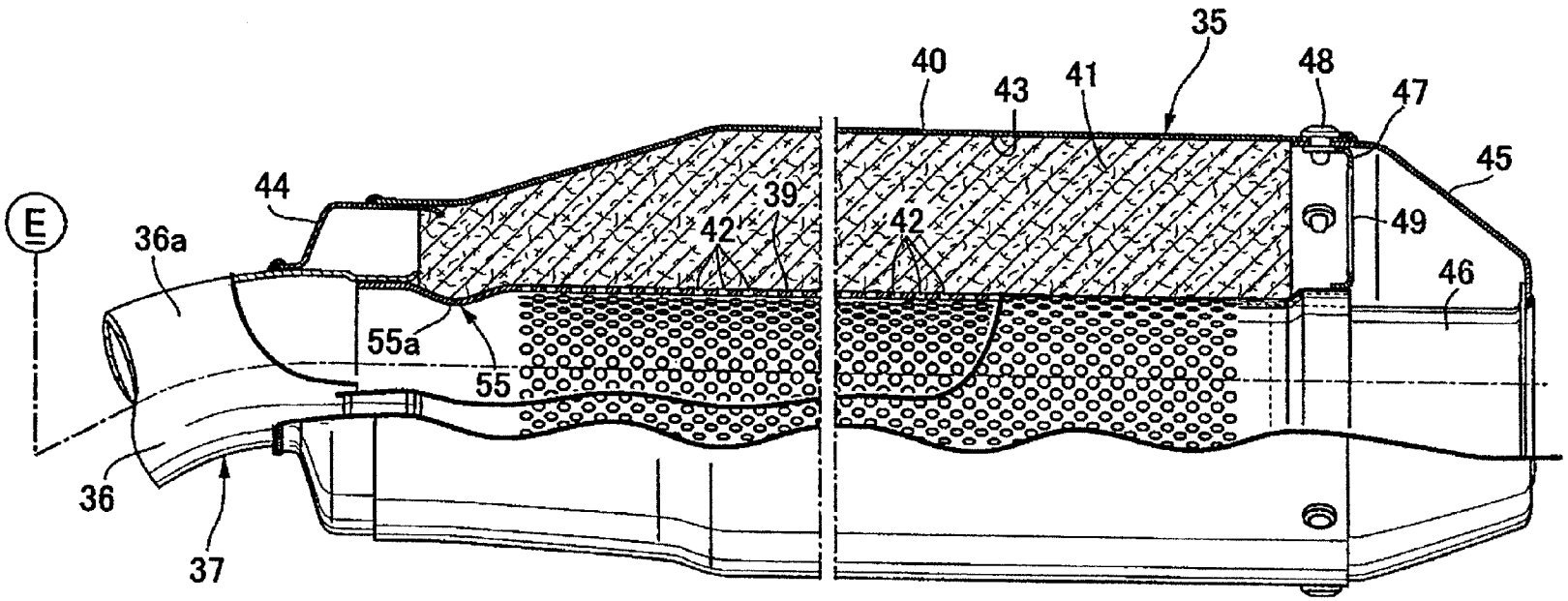
FIG. 8 is a horizontally sectional plan view corresponding to FIG. 3, showing embodiment 2.

Embodiment 2 of the present invention will be described below with reference to FIG. 8. Those parts of Embodiment 2 which correspond to those of Embodiment 1 are denoted by identical reference symbols, and will not be described in detail below.

In this example, a flow rectifying means 55 includes a protrusion 55*a* which projects inwardly from the inner surface of the inner pipe 39 in the region where the pressure distribution of the exhaust gas in the upstream end of the inner pipe 39 downstream of the curved portion 36*a* which is located in the downstream portion of the exhaust pipe 36 exhibits a high pressure, i.e., outwardly of the curved direction of the curved portion 36*a* (on the right-hand side in Embodiment 2). The flow rectifying means 55 is disposed in the upstream end of the inner pipe 39 as an inward dent of the upstream end of the inner pipe 39.

According to Embodiment 2, since the flow of the exhaust gas is rectified by the protrusion 55*a* of the flow rectifying means 55, the pressure of the exhaust gas in the inner pipe 39 is uniformized and the flow of the exhaust gas is made smooth, thus increasing the engine output. Even though the annular chamber 43 between the inner pipe 39 and the outer pipe 40 is filled the acoustic absorbent 41, the acoustic absorbent 41 will not suffer an unbalanced deterioration, and will be replaced at an extended interval.

Embodiment 3

Figure 9:
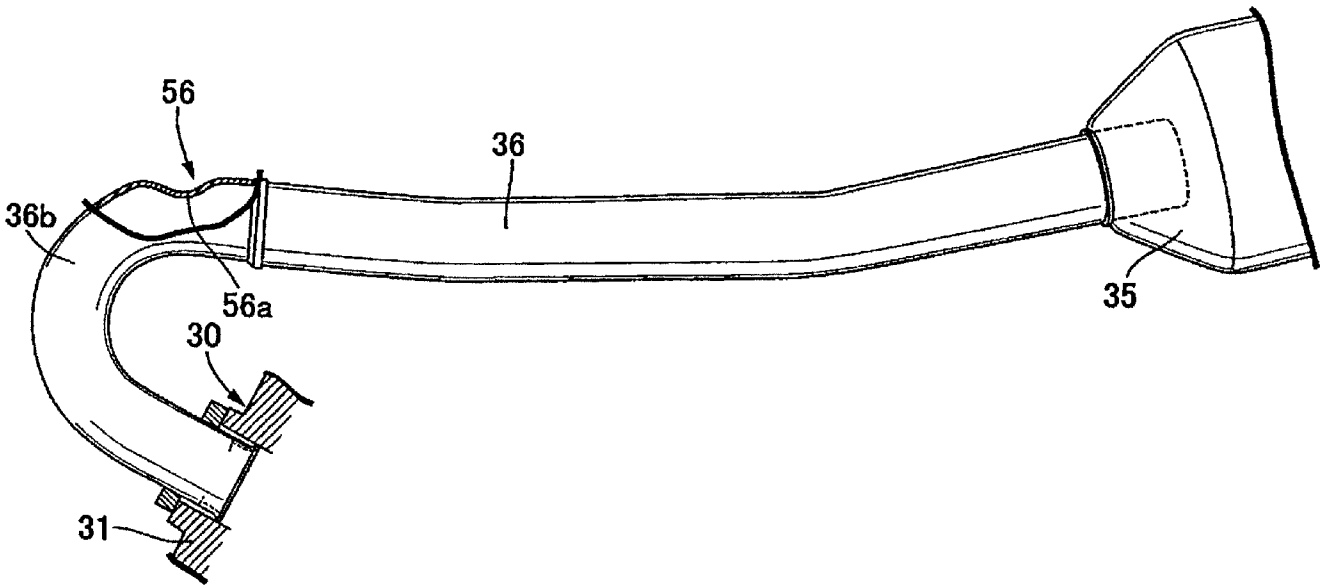
FIG. 9 is a plan view showing a portion of an exhaust device according to embodiment 3.

Embodiment 3 of the present invention will be described below with reference to FIG. 9. Those parts of Embodiment 3 which correspond to those of Embodiments 1, 2 are denoted by identical reference symbols, and will not be described in detail below.

The exhaust pipe 36 of the exhaust device 37 has on its upstream portion a curved portion 36*b* extending slightly forwardly from the front side wall of the cylinder head 31 and then curved to the right of the cylinder head 31. A flow rectifying device or means 56 has a protrusion 56*a* which projects inwardly from the inner surface of the inner pipe 39 in the region where the pressure distribution of the exhaust gas exhibits a high pressure downstream of the curved portion 36*b*, i.e., outwardly of the curved direction of the curved portion 36*b* (on the right-hand side in Embodiment 3). The flow rectifying means 56 is disposed in the exhaust pipe 36 as an inward dent of a portion of the exhaust pipe 36.

According to Embodiment 3, even though the curved portion 36*b* is provided in the exhaust pipe 36 so as to develop a pressure distribution such that the pressure of the exhaust gas changes circumferentially in the exhaust pipe 36, since the flow of the exhaust gas is rectified by the protrusion 56*a* of the flow rectifying means 56 downstream of the curved portion 36*b*, the pressure of the exhaust gas in the exhaust pipe 36 is effectively uniformized and the flow of the exhaust gas is made smooth, thus increasing the engine output.

While the embodiments of the present invention have been described above, the present invention is not limited to the above embodiments, but various changes of design may be made therein without departing from the spirit and scope of the claims.

For example, the inner pipe 39 of the muffler 35 or the exhaust pipe 36 may be deformed into an elliptical cross-sectional shape to provide a flow rectifying means.

35 . . . Muffler
36 . . . Exhaust pipe
36*a* . . . Curved portion
37 . . . Exhaust device
39 . . . Inner pipe
40 . . . Outer pipe
41 . . . Annular chamber
42 . . . Vent hole
50, 55, 56 . . . Flow rectifying means
51 . . . First flow rectifying member
51*b*, 52*b*, 55*a*, 56*a* . . . Protrusion
52 . . . Second flow rectifying member
E . . . Engine

We claim:

1. An exhaust device for an engine, said exhaust device including: an exhaust pipe having a curved portion;

a flow rectifying means for rectifying a flow of an exhaust gas, said flow rectifying means being disposed in an upstream end of an inner pipe, said flow rectifying means comprising protrusions projecting inwardly, and being attached to an inner surface of the inner pipe, said inner pipe being connected to an end of the exhaust pipe, wherein the exhaust gas engaging said flow rectifying means has passed through the curved portion of the inner pipe, and wherein the inner pipe also includes a muffler having a plurality of vent holes disposed in an inner portion thereof, and an outer pipe surrounding the inner pipe, defining an angular chamber therebetween, and wherein said flow rectifying means comprises a first flow rectifying member attached to the inner surface of the inner pipe, outwardly of a curved direction of the curved portion of the exhaust pipe, and a second flow rectifying member attached to the inner surface of the inner pipe, downstream of the first flow rectifying member, said first and second flow rectifying members having the protrusions projecting integrally therewith, inwardly from an inner surface of the upstream end of the inner pipe, wherein the flow rectifying means uniformizes exhaust gas pressure in the inner pipe.

2. The exhaust device according to claim 1, wherein said flow rectifying means is disposed downstream of said curved portion, on an outwardly disposed section thereof.

3. The exhaust device according to claim 1, wherein one of said protrusions is angularly disposed so as to be progressively spaced from the inner surface of the inner pipe downstream with respect to the direction in which the exhaust gas flows, and wherein the distance between the projecting end of the at least one protrusion and the inner surface of the inner pipe in a region where a pressure distribution of the exhaust gas in the inner pipe exhibits a highest pressure is greater than distances at other portions of the projecting end.

4. The exhaust device according to claim 1, wherein the first and second flow rectifying members include an arcuate cross-sectional shape in a plane perpendicular to an axis of the inner pipe.

5. An exhaust device for an engine, comprising:

an exhaust pipe having an inner surface thereof and a curved portion configured to be attached to the engine at an upstream portion thereof, and configured to be attached to a muffler at a downstream portion thereof;

a protrusion projecting inwardly from an inner surface of the exhaust pipe, said protrusion disposed downstream of said curved portion, wherein the protrusion is configured to rectify flow of exhaust gas which has passed through the curved portion by uniformizing exhaust gas pressure in the exhaust pipe.

6. The exhaust device according to claim 5, wherein said protrusion is disposed downstream of said curved portion, on an outwardly disposed section thereof.

7. An exhaust device for an engine, said exhaust device comprising:

an exhaust pipe having an upstream curved portion at one end thereof and a downstream curved portion at another end thereof, said upstream curved portion being configured to be attached to an engine, said downstream curved portion being configured to be attached to a muffler, whereby the muffler comprises an inner pipe having a number of vent holes thereupon, and an outer pipe surrounding the inner pipe, thereby defining an angular chamber between the outer pipe and the inner pipe;

a first flow rectifying protrusion disposed on an inner surface of an upstream end of the inner pipe, said first protrusion being configured to rectify flow of exhaust gas which has passed through the downstream curved portion, said device further comprising a second flow rectifying protrusion, with the first flow rectifying protrusion being attached to the inner surface of the inner pipe, and the second flow rectifying protrusion being fixed to the inner surface of the inner pipe downstream of the first flow rectifying protrusion, with the first and second flow rectifying protrusions projecting integrally inwardly from the upstream end of the inner pipe, wherein the first and second flow rectifying protrusions uniformize exhaust gas pressure in the inner pipe.

8. The exhaust device according to claim 7, wherein the first protrusion is angularly disposed so as to be progressively from the inner surface of the inner pipe downstream with respect to the direction in which the exhaust gas flows there through, and wherein a distance between a projecting end of the first protrusion and the inner surface of the inner pipe, in a region where a pressure distribution of the exhaust gas in the inner pipe exhibits a highest pressure, is greater than the distances at other portions of the projecting end.

9. The exhaust device according to claim 8, wherein the first and second flow rectifying protrusions comprise an arcuate cross-sectional shape in a plane perpendicular to an axis of the inner pipe.

10. The exhaust device according to claim 9, wherein the at least one flow rectifying protrusion is disposed downstream of the downstream curved portion, on an outwardly disposed section thereof.

11. An exhaust device for an engine, comprising:

an exhaust pipe having a curved portion at an upstream end thereof; and at least one flow rectifying protrusion projecting inwardly from an inner surface of the exhaust pipe, said flow rectifying protrusion disposed downstream of the curved portion, said protrusion configured to rectify a flow of an exhaust gas which has passed through the curved portion by uniformizing exhaust gas pressure in the exhaust pipe.

12. The exhaust device according to claim 11, wherein the flow rectifying protrusion is disposed to project inwardly from an outward section of the exhaust pipe.

* * * * *